US006595429B1

(12) United States Patent
Carlson et al.

(10) Patent No.: US 6,595,429 B1
(45) Date of Patent: Jul. 22, 2003

(54) APPARATUS AND METHOD FOR PROVIDING CONTINUOUS REAL-TIME CONDITIONED AIR CURTAIN

(75) Inventors: Dennis L. Carlson, Waukesha, WI (US); Charles A. Zimmermann, Pewaukee, WI (US)

(73) Assignee: ASI Technologies, Inc., Milwaukee, WI (US)

( * ) Notice: Subject to any disclaimer, the term of this patent is extended or adjusted under 35 U.S.C. 154(b) by 0 days.

(21) Appl. No.: 10/115,720

(22) Filed: Apr. 3, 2002

(51) Int. Cl.[7] ..... B01F 3/02; F24F 9/00

(52) U.S. Cl. ..... 236/44 R; 454/188

(58) Field of Search ..... 454/188; 62/256, 62/176.5, 176.6, 90

(56) References Cited

U.S. PATENT DOCUMENTS

| | | | | |
|---|---|---|---|---|
| 1,915,704 | A | 6/1933 | Warren | |
| 2,558,997 | A | 7/1951 | Voelker | 62/89 |
| 2,706,387 | A | 4/1955 | Swanson | 62/117.4 |
| 2,827,266 | A | 3/1958 | Ruff | 257/9 |
| 3,023,688 | A | 3/1962 | Kramer, Jr. | 98/36 |
| 3,025,681 | A | 3/1962 | Booth | 62/248 |
| 3,206,187 | A | 9/1965 | Cagley | 268/64 |
| 3,218,952 | A | 11/1965 | Gygax | 98/36 |
| 3,326,012 | A | 6/1967 | Asker et al. | 62/78 |
| 3,462,966 | A | 8/1969 | Reid et al. | 62/248 |
| 3,687,053 | A | 8/1972 | Henson et al. | 98/33 |
| 3,817,160 | A | 6/1974 | Searcy et al. | 98/36 |
| 3,859,900 | A | 1/1975 | Fordsmand | 98/36 |
| 3,998,142 | A | 12/1976 | Foreman et al. | 98/36 |
| 4,009,586 | A | 3/1977 | Skvarenina | 62/80 |
| 4,074,620 | A | 2/1978 | Jansson | 98/36 |
| 4,109,484 | A | 8/1978 | Cunningham | 62/256 |
| 4,427,049 | A | 1/1984 | Belanger et al. | 160/199 |
| 4,432,406 | A | 2/1984 | Belanger et al. | 160/199 |
| 4,516,482 | A | 5/1985 | Smith | 98/36 |
| 4,855,567 | A | 8/1989 | Mueller | 219/218 |
| 4,950,869 | A | 8/1990 | Mueller | 219/218 |
| 5,203,175 | A | 4/1993 | Farrey et al. | 62/82 |
| 5,329,781 | A | 7/1994 | Farrey et al. | 62/82 |
| 5,339,643 | A | 8/1994 | Pikaart | 62/80 |
| 6,058,722 | A * | 5/2000 | Choi | 62/256 |
| 6,106,387 | A | 8/2000 | Smith | 454/190 |
| 6,508,408 | B2 * | 1/2003 | Kelley et al. | 62/176.5 |

OTHER PUBLICATIONS

Applicant's Exhibit A, "flexaire barrier", four–page brochure of Flexon, Leetsdale, PA, 1997, admitted prior art.

Applicant's Exhibit B, "Conditioned Air Curtain", four–page brochure of HCR, Inc., Falls Church, VA, undated, admitted prior art.

(List continued on next page.)

*Primary Examiner*—William Wayner
(74) *Attorney, Agent, or Firm*—Quarles & Brady LLP

(57) ABSTRACT

An air curtain providing an air stream across a doorway between areas of relatively cool and warm air masses and continuously monitoring the condition, e.g., temperature, pressure and flow rate, of one or both air masses and the air stream. The air curtain has a control system including an electronic controller operating a heater and fan and receiving air characteristic inputs from temperature, pressure and flow rate sensors. The controller monitors these inputs continuously and processes them to operate the heater and fan according to algorithms designed to minimize air cross-filtration and energy consumption while maintaining the temperature and humidity of the air stream at a point substantially along a line representing the mixing of anteroom air and the air stream that is substantially tangent to the psychrometric saturation curve. A method of maintaining a non-saturated air stream across a freezer doorway, so as to prevent condensation and reduce the formation of fog and frost at the doorway, is also disclosed.

21 Claims, 3 Drawing Sheets

U.S. PATENT DOCUMENTS

Applicant's Exhibit C, "Frost–Free Airlok–Door" .sixteen–page instruction manual of HCR, Inc., Lewistown, MT, undated, admitted prior art.

Applicant's Exhibit D, "Frost–Free Freezer Doorways", forty–page product bulletin of HCR, Inc., Lewistown, MT, undated, admitted prior art.

Applicant's Exhibit E, "Model DCAV Conditioned Air Vestibules", twenty–four page instruction booklet of HCR, Inc., undated, Falls Church, VA, admitted prior art.

Applicant's Exhibit F, "The Problems of Frost, Fog, and Ice in Freezers: Part 1—The Cause", five–page operations bulletin of HCR, Inc., Falls Church, VA, Aug. 1993, admitted prior art.

Applicant's Exhibit G, "The Problems of Frost, Fog, and Ice in Freezers: Part2—The Solution", five–page operations bulletin of HCR, Inc., Falls Church, VA, Sep. 1983, admitted prior art.

* cited by examiner

APPARATUS AND METHOD FOR PROVIDING CONTINUOUS REAL-TIME CONDITIONED AIR CURTAIN

CROSS-REFERENCE TO RELATED APPLICATIONS

Not Applicable

STATEMENT OF FEDERALLY SPONSORED RESEARCH OR DEVELOPMENT

Not Applicable

BACKGROUND OF THE INVENTION

1. Field of the Invention

This invention relates to an apparatus for preventing cross-filtration of relatively cool and warm air masses at the opening of a refrigerated space, and particularly, for an air curtain that continuously monitors and optimizes the condition of the circulating air stream to eliminate the formation of fog and frost at the opening.

2. Background and Description of the Prior Art

Refrigerated warehouses typically have one or more cold storage rooms adjacent to rooms at more moderate temperatures. At open doorways between these rooms some of the lighter, warm air will flow into the cool area primarily through the top of the doorway (warm air infiltration) in exchange for heavier, cool air at the bottom of the doorway (cold air exfiltration). Depending upon the conditions of the two air masses, this cold air exfiltration and warm air infiltration can cause numerous problems. Infiltrating warm air can carry more moisture than cool air and tends to become supersaturated within the cold room or at the door opening, which leads to precipitation or airborne ice crystals at the doorway. The humid warm air also leads to ice build-up within the cold room, especially on the floor, doors, walls, evaporator coils, and/or products adjacent to the doorway and inflates energy costs for refrigerating the cold rooms. The exfiltrating cool air tends to mix with the humid warm air to cause fog at the warmer side of the doorway. The fog reduces visibility and can lead to wet slippery floors at the doorway.

There have been many attempts in the prior art to minimize the adverse effects of the colliding air masses at the doorways of cold storage rooms. Commonly, a physical barrier of some type is utilized at the doorway. Such barriers include sliding doors having overlapping edges or sweeps that reduce the air flow through the gaps around the door panels. Sliding doors hamper passage through the doorway and allow heavy infiltration during high door operation periods. These high door operation periods can cause ice build-up and mass air infiltration and exfiltration. Another type of physical barrier is a strip door with transparent plastic or vinyl strips hanging from the doorway header. Strip doors are typically low-cost but they impede passage through the doorway, and the strips can separate with use allowing cross-filtration of the air. Once this begins to occur, the strips can become coated with ice so as to reduce visibility through the doorway and allow for greater air infiltration.

Rather than a physical barrier, the doorways of cold storage rooms can be "closed" by an active air barrier, commonly referred to as an "air curtain", allowing unobstructed passage through the doorway. An air curtain is formed by a fan or air mover producing a relatively high velocity air stream across the doorway, either from side to side or top to bottom, to counteract the forces of the cross-filtrating air masses. A heater may be used to condition the air stream so as to maintain the temperature of the air sufficient to prevent saturation (and thus condensation) of the air at the doorway.

One known air curtain apparatus is disclosed in U.S. Pat. No. 4,516,482. This patent discloses an air curtain vestibule mounted at a freezer door having duct-work containing an air mover and a heater. The apparatus is designed to heat the air curtain to a temperature sufficient to avoid supersaturation of air infiltrating the freezer and saturation of exfiltration air entering the outside of the freezer (the warmer side). This is accomplished by heating the recirculating air to a temperature that brings the mixed air to a point along a line tangent to the saturation curve (100% humidity line) on the psychrometric chart. This allows for air infiltration and exfiltration without condensation. The recirculating air temperature is determined based on normal operating conditions of the freezer and the anteroom (outside the freezer) and the heater is set to maintain this temperature. U.S. Pat. No. 6,106,387 discloses a similar air curtain, however, using an electronic controller and a plurality of temperature and humidity sensors. Like the '482 patent, the heater is operated to maintain a pre-selected temperature that results in a relative humidity along a line tangent to the saturation curve on the psychrometric chart.

Since these systems maintain a pre-selected temperature, they do not adjust operating parameters in response to transient or changed conditions of the air masses, for example, due to significant changes in weather or anteroom conditions. As such, the system can operate improperly (causing fog or frost) and in an energy inefficient manner until the condition returns to normal or until the improper condition is detected and the system is manually reconfigured to adjust operating parameters, which may require one or more time consuming and costly service calls.

SUMMARY OF THE INVENTION

The present invention improves upon prior art air curtains by continuously monitoring the state, for example the temperature and humidity, of one or both ambient air masses and the curtain air stream. The air stream is then conditioned in a way that minimizes air cross-filtration and energy consumption while maintaining the temperature and humidity of the air stream at a point substantially along or slightly below a line representing the mixing of the air masses and the air stream that is tangent to the psychrometric saturation curve.

In particular, the present invention is an apparatus for forming an air stream across a doorway between relatively cool and warm air areas. The apparatus includes an air mover for moving an air stream across the doorway and a heater in thermal communication with the air stream for warming the air stream. The apparatus also includes an electronic control unit controlling the operation of the heater as well as at least one air sensor located in at least one of the air areas providing an air input to the control unit and a second air sensor located in communication with the air stream providing an air stream input to the control unit. The control unit continuously monitors the air and air stream inputs and operates the heater to maintain the temperature of the air stream at a point substantially along a line representing the mixing of air from one or both of the relatively warm and cool air areas and the air stream that is tangent to the psychrometric saturation curve.

The invention also provides a method of maintaining a non-saturated air curtain across a doorway between relatively cool and warm air areas so as to prevent condensation and the formation fog and frost at the doorway. The method includes monitoring continuously the condition of the relatively warm and/or cool ambient air areas and the condition of the air stream and conditioning the air stream to maintain its temperature and humidity at a point substantially along or slightly below a line that is tangent to the psychrometric saturation curve representing the mixing of the air and the air stream.

By continuously monitoring the state of the air stream and at least one of the air masses, the apparatus of the present invention can efficiently prevent the air stream from becoming saturated and forming condensation at the doorway. The heater is operated by the controller in real-time to maintain the temperature and relative humidity of the air stream just below saturation. The controller approximates the psychrometric curve using a unique quadratic equation and computes the necessary air stream temperature by evaluating the mixing line equation with the values input by the temperature and humidity sensors. This temperature also corresponds to the lowest approximate air stream temperature maintaining non-saturation, thereby minimizing heat input (and associated costs) and improving energy efficiency of the system.

In a preferred form, the apparatus is an air curtain having a supply air plenum with an outlet aperture at a first side of the doorway, a return air plenum with an inlet aperture at a second side of the doorway and an intermediate air plenum extending between the supply and return air plenums. The air curtain includes pairs of temperature and humidity sensors, one pair preferably located in the relatively warm air area and the other pair located in the air stream. The temperature and humidity sensors provide signals to the control unit indicating the temperature and humidity at the warm area and the air stream, which are processed by the control unit for operation of the heater.

In other preferred forms, the air curtain further includes pressure sensors located in the relatively cool and warm air areas providing respective cool and warm air pressure input signals to the control unit. The control unit continuously monitors the pressure input and operates the air mover at a threshold pressure differential to minimize cross-filtration through the doorway. The air curtain can also include an air speed sensor detecting air velocity through the doorway and providing an air cross-filtration speed input to the control unit. The control unit continuously monitors the air cross-filtration speed input signal and operates the air mover to minimize cross-filtration through the doorway. Still further, the air curtain can be designed to mix dehumidified air flow with the air stream, for example, air from the cool air area.

The air curtain thus substantially reduces cross-filtration, and the related adverse effects, of two or more adjacent air masses at the opening of a cooled space. In particular, the air curtain substantially reduces warm air infiltration and cold air exfiltration. By continuously monitoring pressure sensors located in the relatively cool and warm air areas and/or the velocity of air passing through the doorway, the air mover can be operated in real-time to adjust the air curtain speed as needed due to random or other changes in the state of the air masses. The air curtain of the present invention also reduces or eliminates air stream saturation and condensation by mixing dehumidified or low moisture air with the air stream.

The foregoing and other objects and advantages of the invention will appear from the following description. In this description reference is made to the accompanying drawings which form a part hereof and in which there is shown by way of illustration a preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENT

Figure 1:
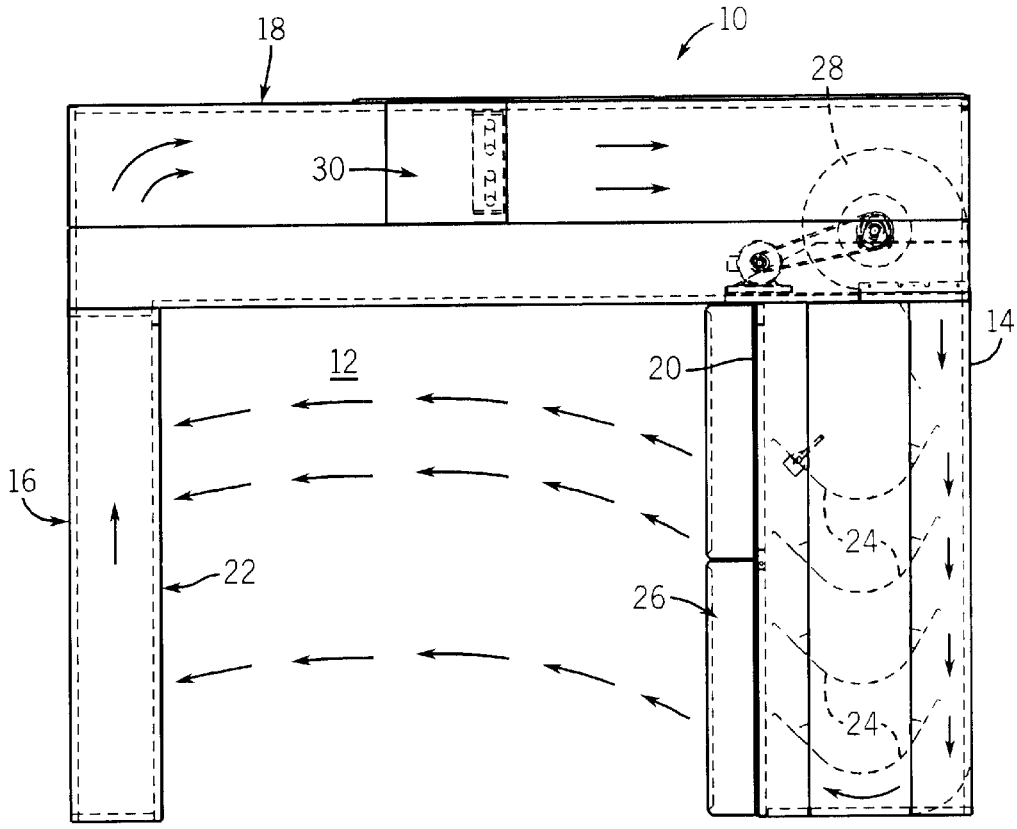
FIG. 1 is a front view of an air curtain vestibule of the present invention.
Figure 2:
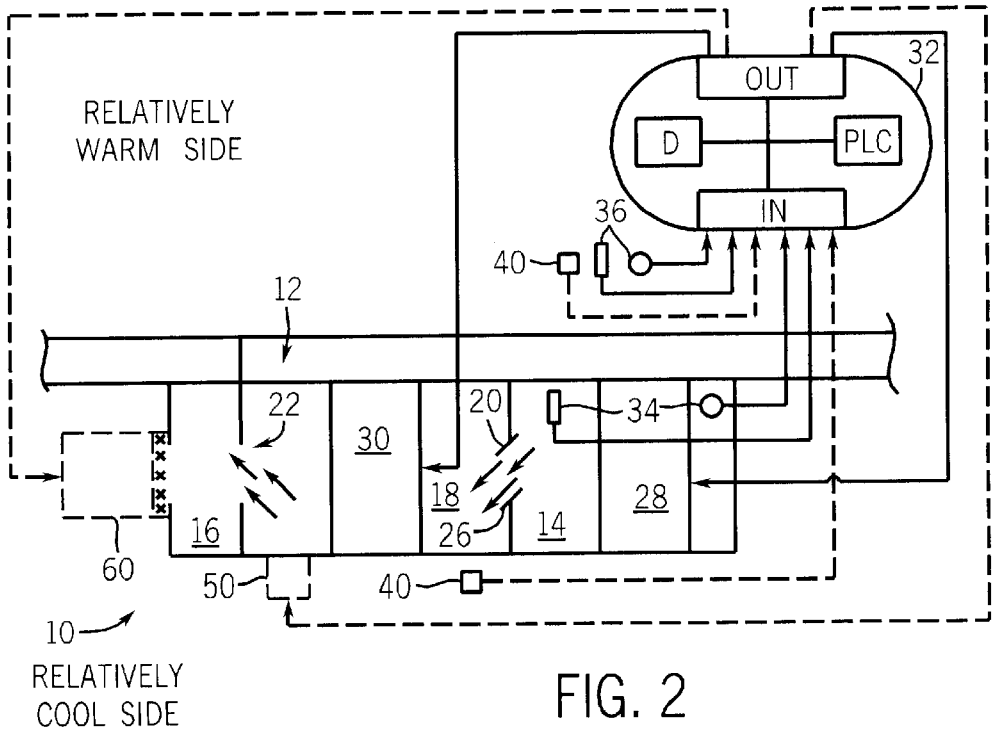
FIG. 2 is a schematic view showing the air curtain vestibule with a control system.

Referring to FIGS. 1 and 2, an air curtain 10 for forming an air stream across a doorway 12 between relatively cool and warm air areas, such as at a cold storage room or freezer, has a supply air plenum 14, a return air duct 16 and an intermediate air duct 18. The air curtain 10 is placed on the floor around the doorway 12 and secured to a jamb structure, preferably at the cool side, such that the supply air plenum 14 is along one side of the doorway 12 and the air return duct 16 is along the other side. Placing the air curtain on the cool side of the wall provides for direct introduction of low moisture cool room air into the air stream. The intermediate air duct 18 extends along the top of the doorway 12 and joins the supply plenum 14 and return 16 air duct. The supply plenum 14 and return 16 air duct have open top ends that mate with openings at the ends of the intermediate air duct 18 so that air can pass through the intermediate air duct 18 from the return air duct 16 to the supply air plenum 14. Air from the intermediate air duct 18 is redirected by diverter assemblies 24 and exits the supply air plenum 14 through an outlet aperture 20 at its inner face that extends longitudinally substantially the height of the doorway 12. Air from the supply air plenum 14 is received by the return air duct 16 through an air inlet aperture 22 at its inner face that extends substantially the height of the doorway 12. The inlet aperture 22 opening size decreases from bottom to top to equalize the amount of air taken in along its length. The air curtain 10 thus provides an air pathway through the ductwork and across the doorway 12.

Preferably, a nozzle assembly 26 is mounted along the outlet aperture 20 to direct the air in a desired pathway across the doorway 12. The nozzle assembly 26 preferably is horizontally adjustable and sized to reduce turbulence. Within the intermediate air duct 18, the recirculating air stream, cold air mass, and warm air mass will mix so as to reduce the overall moisture content of the air. The moisture content can be further reduced by introducing additional cool air through an additional opening in the intermediate air duct 18.

The intermediate air duct 18 houses an air mover 28, such as a squirrel cage type centrifugal fan capable of operating at 5,000 CFM, to generate and circulate the air stream. The air mover 28 draws air into the inlet aperture 22 of the return air duct 16, through the intermediate air duct 18 and expels it into the supply air plenum 14 to exit the outlet aperture 20 and form a high-speed substantially laminar (non-turbulent) curtain of air across substantially the entire doorway 12, as indicated by the arrows in FIG. 1. The air stream can have a uniform velocity along the entire length of the outlet aperture 20 or the velocity of the air steam can be varied at different heights, for example, so that higher velocity air flows at the top or bottom. In any event, air flow is directed across the bottom half at a sufficient volume and rate to reduce significant cold air exfiltration into the warm air side and across the top half to prevent warm air infiltration into the cool air side. The air stream takes a curvilinear path away from the door opening to the inside face of the return air duct 16 due to the cold air pressure.

Referring to FIG. 2, the air curtain 10 includes a condition control system including a heater 30, an electronic control unit (ECU) 32 and a plurality of air sensors. The heater 30 may be of any suitable type, such as a passive resistance heater mounted within the intermediate air duct 18 or a forced air heat exchanger mounted outside the ductwork. The ECU 32 preferably includes a programmable logic controller (PLC), a user interface display, an input module and an output module interconnected by a standard bus. The output module of the ECU 32 is electrically coupled to the air mover 28 and the heater 30. The input module of the ECU 32 is electrically coupled to the sensors. Preferably, the air sensors include two sets of temperature and humidity sensors. One set of temperature and humidity sensors 34 is located in the path of the air stream, preferably in the supply air plenum 14 near the outlet aperture. This set of sensors is used to provide feedback to the ECU 32 as to the conditions of the air curtain. The other set of sensors 36 is located in the relatively warm side, preferably mounted six inches off the wall and three feet from one side of the doorway. This set of sensors is used by the ECU 32 to provide data points corresponding to warm side air conditions that are used to adjust the temperature and humidity of the air stream.

A preferred ECU 32 is commercially available from Siemens AG of Munich, Germany. Specifically, the PLC is sold as the Simatic S7-200 (model No. 214-1BD21-0XB0) the display is a text display sold as the Simatic TD 200 (model No. 272-0AA20-0YA0); the input module is a 12-bit analog input module with four input points sold as EM231 (model No. 231-0HC21-0XA0); and the output module is a 12-bit analog out module with two output points sold as EM232 (model No. 232-0HB21-0XA0). The PLC can be programmed on an IBM compatible microprocessor based computer using the ladder logic program available from Siemens. The sets of humidity and temperature sensors are preferably combination sensors commercially available as ACI/TT100/RH3-D-4X from Automation Components, Inc. of Middleton, Wis. The sensors have an operating range of −30° F. to 130° F. and 0% to 100% relative humidity. It should be noted, however, that other control units and sensors could be used to practice the invention.

The control system continuously monitors the condition of the air in the air stream as well as the condition of the warm side air. It should be noted that the cool side air could be monitored instead of or in addition to the warm side air, however, this is unnecessary in many applications because the cool side air is often in a freezer or other cold storage room in which the air condition is maintained at a nearly constant temperature and relative humidity. The ECU 32 processes the inputs received from the sensors 34 and 36 according to an algorithm designed to maintain the air curtain at temperature and relative humidity just below the saturation line so as to prevent condensation and minimize the energy required to heat the air.

Figure 3:
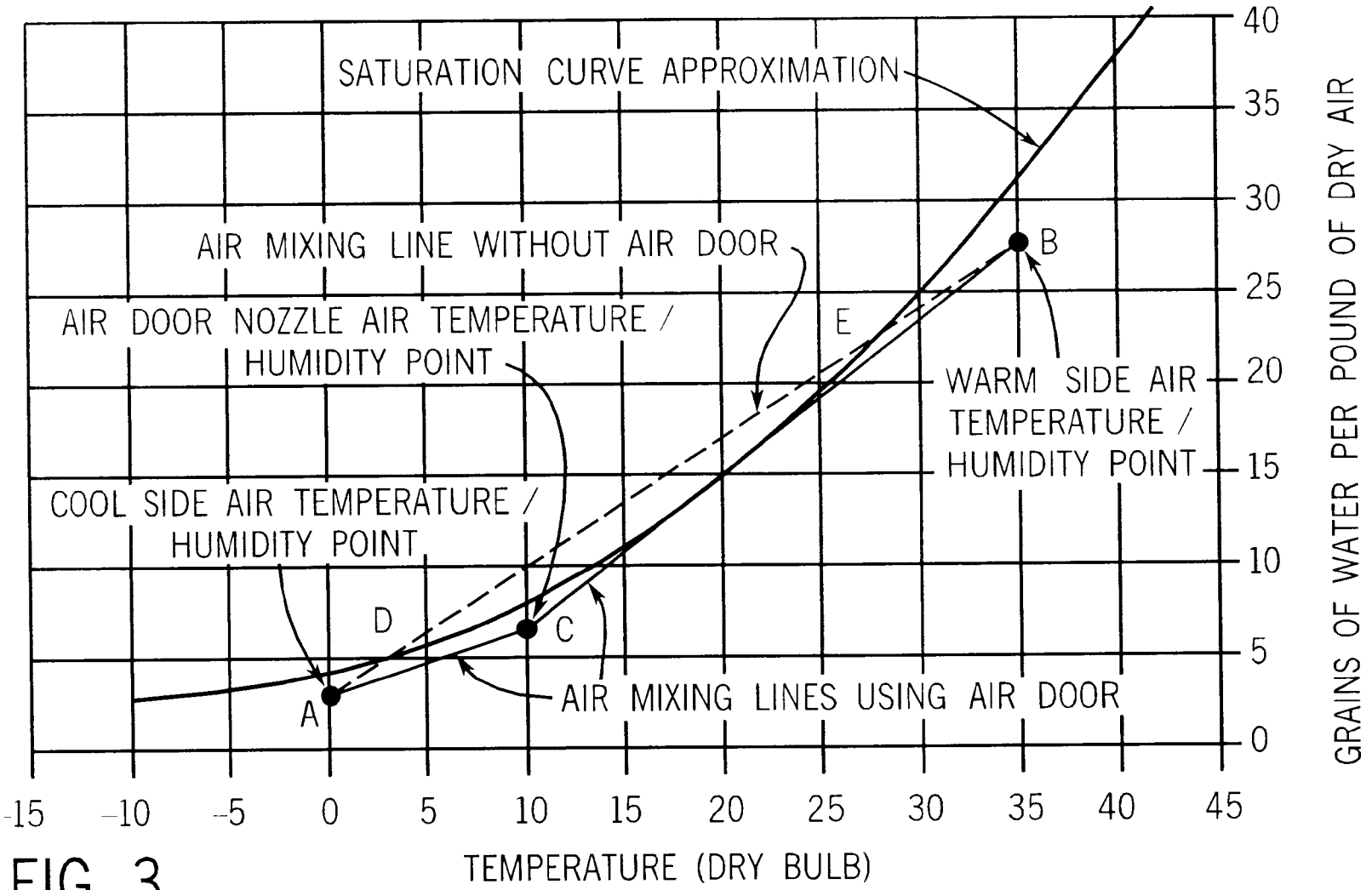
FIG. 3 shows a simplified psychrometric curve with data points for cool room conditions of 0° F., 60% relative humidity, point A, and warm room conditions of 35° F., 85% relative humidity, point B, and showing a mixing line (dashed) of the air masses without conditioning the air curtain and a mixing line tangent to the saturation curve after the air curtain is heated and its relative humidity has been lowered.
Figure 4:
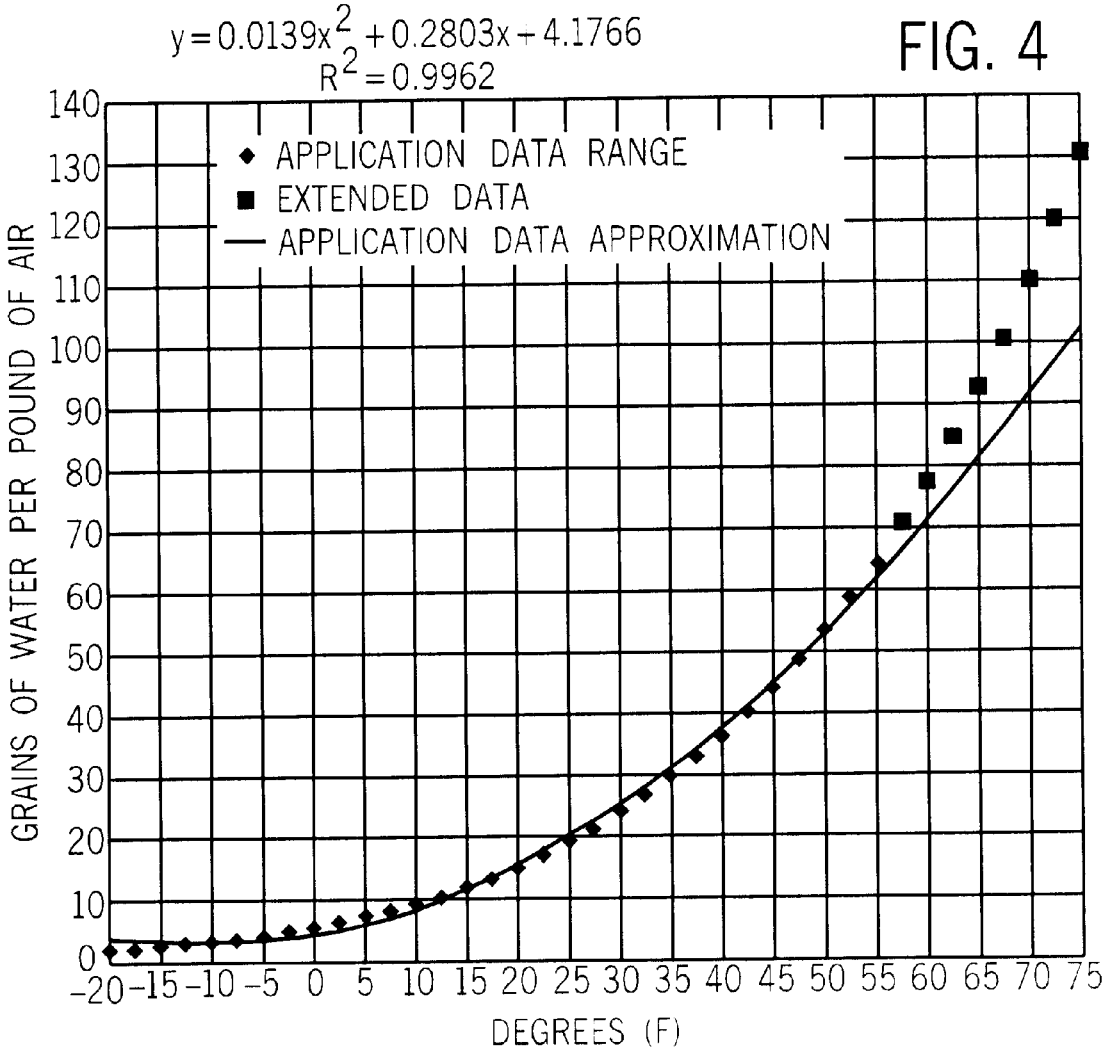
FIG. 4 is a plot of a parabolic approximation of the psychrometric curve.

The logic controller of the ECU 32 is programmed to include a parabolic approximation of the saturation (or 100% relative humidity) curve of the psychrometric chart. A simplified version of the psychrometric chart is shown in FIG. 3. The saturation curve is approximated to simplify computation and avoid mathematical complications in the control circuit. The saturation curve is approximated by the following quadratic equation:

$$y=0.139x^2+0.2803x+4.1766,$$

in which y is in units of grains of water per pound of dry air and x is in units of temperature in degrees Fahrenheit. The approximation curve is plotted as a solid line in the graph of FIG. 4.

To avoid condensation at the air curtain, the mixed air must be conditioned to prevent it from becoming saturated. The temperature and moisture in the mixed air falls along a diagonal process or mixing line plotted on the psychrometric chart (see lines AC and CB of FIG. 3). Condensation is avoided as long as the mixing line is below the saturation curve. A mixing line that intersects a point on the psychrometric chart corresponding to the condition of one of the air masses and that is tangent to the saturation curve represents the minimum temperature and maximum moisture content the air curtain can sustain without becoming saturated. Thus, the amount of heat or cooling (and thus energy) to be added to the air curtain is minimized at this point.

The process or mixing line of the air masses that is tangent to the approximation curve is computed by the equation:

$$y=[(H_{as}-H_a)/(T_{as}-T_a)]x+H_{as}$$

in which $H_{as}$ and $H_a$ are the humidity of the air stream and the anteroom warm side air, respectively, in grains of water per pound of dry air and $T_{as}$ and $T_a$ are the temperatures of the air stream and the anteroom warm air, respectively, in ° F. $T_a$ and $H_a$ are data points collected by the anteroom warm air sensors 36 and $T_{as}$ and $H_{as}$ are data points collected by the air stream sensors 34 at the outlet aperture 20 of the supply air plenum 14. The relative humidity measurements of the sensors can be converted to grains using the equation:

$$\text{Humidity in grains}=(0.0139T^2+0.2803T+4.1766)\times\text{Relative Humidity in which } T \text{ is temperature in } ^\circ\text{F.}$$

Generally, the warm air temperature and relative humidity values are variable in that they are subject to the weather conditions and anteroom conditions. The ECU 32 processes the data collected from the sensors using these equations to arrive at the desired temperature of the air stream given the conditions of the warm side air and falling along a tangent mixing line. If the condition of the warm side air changes, the ECU 32 will process the data and control the heater 30 as needed to raise or lower the air stream temperature. Note that while not shown in the drawings, a cooling coil could be mounted in the ductwork to more rapidly cool the air stream in response to changing air conditions, however, this is largely unnecessary in the described embodiment because the air curtain is mounted at the cool side.

By way of example, FIG. 3 shows an application in which the sensors 36 detect that the warm side air is at 35° F. and 85% relative humidity (point B) and the cool side air is at 0° F. and 60% relative humidity (point A). Ordinarily, the air between the cool and warm air masses would mix along dashed line BA. Mixing line BA intersects the saturation curve at points D and E and is almost entirely in the supersaturated region above the saturation curve. Air mixed along this line will result in condensation at the doorway, thus leading to the formation of frost and fog. However, by heating the air stream and controlling the air mixture percentages of warm side air, cold side air and air stream air, the slope of the mixing line can be changed. Using the above equations, the ECU 32 can calculate a point C corresponding to the air stream temperature and relative humidity that lies along a mixing line extending from point B and tangent to the saturation curve, shown as line CB . As can be seen, the cool side air to nozzle air mixing ling AC and the warm side air to nozzle air mixing line CD are both below the saturation curve so condensation will not occur.

Changes in the warm side air condition are detected by the sensors 36 which causes the ECU 32 to calculate a new temperature and relative humidity point for the air stream that falls along a new mixing line tangent to the saturation curve and intersecting the new warm side air condition. The ECU 32 continuously monitors the sensors and performs these calculations to set the air curtain temperature (and thus relative humidity) as needed to bring the mixing line tangent to the saturation curve (or slightly therebelow).

By continuously monitoring the state of the air stream and at least one of the air masses, the apparatus of the present invention can prevent the air stream from becoming saturated and forming condensation at the doorway. The heater is operated by the controller in real-time to maintain the temperature and relative humidity of the air stream (and thus any cross-filtrating air) just below saturation. This temperature also corresponds to the lowest approximate temperature maintaining non-saturation, thereby minimizing heating costs and improving energy efficiency of the system.

Referring again to FIG. 2, the vestibule could also include a set of pressure or air flow sensors 40, one on each side of the doorway, to detect the actual or expected cross-filtration of the air masses. In other words, the sensors could detect the pressure differential between the relatively warm and cool sides and/or the velocity of air flowing off of the air curtain (generally transverse to the doorway) to determine the amount of air from either side passing through the doorway. The values input from the sensors 40 could then be processed by the ECU 32 to control the operation of the air mover 28. That is, the velocity of the air curtain could be increased as needed to reduce bulk air movement through the doorway. Additionally, while not shown, the nozzle assembly could be powered and electrically coupled to the ECU 32 to change the direction of the air stream. For example, the nozzle assembly could be moved to point the air stream more directly at the higher pressure side. Still further, the nozzle assembly could have upper, middle and lower blade sections that could be independently operated by the ECU 32 to direct portions of the air curtain in different directions and at different velocities. For example, the upper portion of the air curtain could be directed toward the warm side to combat warm air infiltration and the lower portion of the air curtain could be directed toward the cool side to prevent cool air exfiltration.

The air curtain thus substantially reduces cross-filtration, and the related adverse effects, of two or more adjacent air masses at the opening of a cooled space. In particular, the air curtain substantially reduces warm air infiltration and cold air exfiltration out of the cooled space. By continuously monitoring pressure sensors located in the relatively cool and warm air areas and/or the velocity of air passing through the door way, the air mover can be operated in real-time to adjust the air curtain speed as needed due to random or other changes in the state of the air masses.

The air curtain could also be made to introduce low moisture air into the air curtain. For example, component 50 could be mounted over an opening in the intermediate air duct 18 upstream from the heater 30. This component could be simply a gate operated by the ECU 32 to let in air from the cool side, which typically has a low moisture content due to its low temperature. The component 50 could also be a dehumidifier or a part of a larger dehumidification system that supplies reduced moisture content air to the air curtain. Such a dehumidifier/dehumidification system would preferably carry in external air or air from the warm side that has a relatively high temperature, thus further lowering the energy needed to heat the air curtain. The dehumidification system and the opening to the ductwork could also be controlled by the ECU 32. Further, the air curtain could also include an air filtration system such as unit 60 mounted over an opening in the return air plenum 16 and using conventional filters and techniques for removing small particles and contaminants from the air curtain. A desiccant, such as silica gel, for example, could be used to dry the air.

Illustrative embodiments of the invention have been described in detail for the purpose of disclosing a practical, operative structure whereby the invention may be practiced advantageously. However, the apparatus described is intended to be illustrative only, and the novel characteristics of the invention may be incorporated in other structural forms without departing from the scope of the invention. For example, although described herein as mounted in the cool side, the air curtain could be mounted within the doorway or at the warm side. Moreover, the air curtain could be used in conjunction with any suitable conventional panel or strip doors providing a physical barrier covering the doorway. In that case, however, the doors preferably would be suitable for operation by the ECU and the air curtain would include sensors for detecting traffic through the doorway so that the doors could be opened automatically per use or be held open continuously during high traffic times of the day.

Accordingly, to apprise the public of the full scope of the invention, the following claims are made:

1. An apparatus for forming an air stream across a doorway between areas of relatively cool and warm air masses including a supply air plenum with an outlet aperture at a first side of the doorway, a return air duct with an inlet aperture at a second side of the doorway and an intermediate air duct extending between the supply plenum and return air duct, the apparatus comprising:

an air mover for moving an air stream across the doorway into the inlet aperture to the return air duct through the intermediate air duct to the supply air plenum and out of the outlet aperture;

a heater in thermal communication with the air stream for warming the air stream;

an electronic control unit controlling the operation of the heater;

a first air sensor located in one of the relatively cool and warm air areas providing an air characteristic input to the control unit; and a second air sensor located in contact with the air stream providing an air stream characteristic input to the control unit;

wherein the control unit continuously monitors the air characteristic input and the air stream characteristic input and operates the heater to maintain the temperature of the air stream at a point substantially along a line representing the mixing of the air stream with one or both of the air masses that is tangent to the psychrometric saturation curve.

2. The apparatus of claim 1, wherein the first air sensor is located in the relatively warm air area.

3. The apparatus of claim 2, wherein the first air sensor includes a first temperature sensor and a first humidity sensor and the second air sensor includes a second temperature sensor and a second humidity sensor, wherein the first and second temperature sensors provide respective first and second temperature signals to the control unit and the first and second humidity signals provide respective first and second humidity signals to the control unit.

4. The apparatus of claim 3, wherein the second air sensor is located downstream from the air mover.

5. The apparatus of claim 4, wherein the second air sensor is located in the supply air plenum.

6. The apparatus of claim 5, wherein the heater is located in the intermediate air duct.

7. The apparatus of claim 6, wherein the control unit is programmed with a parabolic approximation of the saturation curve.

8. The apparatus of claim 7, wherein the parabolic approximation is generated by the equation $y=0.139x^2+0.2803x+4.1766$, wherein y is in units of grains of water per pound of dry air and x is in units of temperature in degrees Fahrenheit.

9. The apparatus of claim 8, wherein the mixing line is defined by the equation $y=[(H_{as}-H_a)/(T_{as}-T_a)]x+H_{as}$ wherein $H_{as}$ and $H_a$ are the humidity of the air stream and anteroom air from the relatively warm air area, respectively, in grains of water per pound of dry air and $T_{as}$ and $T_a$ are the temperatures of the air stream and the anteroom air, respectively, in Fahrenheit.

10. The apparatus of claim 1, further including:

a first pressure sensor located in the relatively cool air area providing a cool air pressure input to the control unit; and a second pressure sensor located in the relatively warm air area providing a warm air pressure input to the control unit;

wherein the control unit continuously monitors the pressure input signals and operates the air mover to minimize cross-filtration through the doorway.

11. The apparatus of claim 1, further including an air speed sensor detecting air velocity through the doorway and providing a cross-filtration air speed input to the control unit, wherein the control unit continuously monitors the air speed input to minimize cross-filtration through the doorway.

12. The apparatus of claim 1, wherein the air stream includes dehumidified air flow drawn into the air stream.

13. The apparatus of claim 1, further including a filtration system removing contaminants in the air stream.

14. A method of maintaining a non-saturated air stream across a doorway between areas of relatively cool and warm air masses so as to prevent condensation and the formation fog or frost at the doorway, wherein the air stream is generated by an air curtain including a supply air plenum with an outlet aperture at a first side of the doorway through which an air stream is forced across the doorway to an inlet aperture of a return air duct at a second side of the doorway, the method comprising:

monitoring continuously the condition of the air stream and the condition of at least one of the relatively cool and warm ambient air areas; and conditioning the air stream to maintain the temperature and humidity of the air stream at a point substantially along a line representing the mixing of the air stream with one or both of the air masses that is tangent to the psychrometric saturation curve.

15. The method of claim 14, wherein the air curtain includes a heater, an electronic control unit and temperature and humidity sensors, wherein the control unit controls operation of the heater according to temperature and humidity input received from the temperature and humidity sensors.

16. The method of claim 15, further comprising:

monitoring the pressure of the relatively cool air and the relatively warm air; and adjusting the air stream flow rate so to minimize cross-filtration through the door way.

17. The method of claim 16, wherein the air curtain further includes an air mover generating the air stream and wherein the control system further includes pressure sensors, wherein the control unit operates the air mover according to input from the pressure sensors.

18. The method of claim 14, further comprising:

monitoring the flow rate of air flowing away from the air stream; and adjusting the air stream flow rate so to minimize cross-filtration through the door way.

19. The method of claim 14, further comprising mixing air from the cool air area into the air stream.

20. The method of claim 14, further comprising mixing de-humidified air into the air stream.

21. The method of claim 14, further comprising filtering the air stream to remove contaminants therein.

* * * * *